US006622763B2

(12) United States Patent
Chen

(10) Patent No.: US 6,622,763 B2
(45) Date of Patent: Sep. 23, 2003

(54) BAMBOO VENETIAN BLIND PANELS AND METHOD FOR MANUFACTURING THE SAME

(75) Inventor: Chin-Yu Chen, Chang Hua Hseng (TW)

(73) Assignee: Dong Liang Industrial Co., Ltd., Chang Hua Hseng (TW)

( * ) Notice: Subject to any disclaimer, the term of this patent is extended or adjusted under 35 U.S.C. 154(b) by 53 days.

(21) Appl. No.: 10/029,152

(22) Filed: Dec. 31, 2001

(65) Prior Publication Data

US 2003/0121620 A1 Jul. 3, 2003

(51) Int. Cl.[7] ..... B27G 11/00

(52) U.S. Cl. ..... 144/350; 144/348; 144/352; 144/355; 428/106; 428/378; 428/537.1; 156/250

(58) Field of Search ..... 144/344, 345, 144/346, 348, 350, 352, 355, 364, 366, 369; 160/166.1; 156/65, 250, 252, 253, 256, 259, 264; 428/105–107, 378, 537.1, 17, 18, 113, 114, 172, 370

(56) References Cited

U.S. PATENT DOCUMENTS 5,441,787 A * 8/1995 Fujii et al. ..... 428/57
5,505,238 A * 4/1996 Fujii et al. ..... 144/4.2
5,896,903 A * 4/1999 Chen et al. ..... 144/350
5,967,207 A * 10/1999 Chen ..... 144/345
5,972,467 A * 10/1999 Washo ..... 428/107
5,976,644 A * 11/1999 Sanaee et al. ..... 428/17
6,098,680 A * 8/2000 Nien ..... 144/380
6,192,949 B1 * 2/2001 Nien ..... 144/350
6,321,803 B1 * 11/2001 Nien ..... 144/350

* cited by examiner

*Primary Examiner*—Allen Ostrager
*Assistant Examiner*—Shelley Self
(74) *Attorney, Agent, or Firm*—Rosenberg, Klein & Lee

(57) ABSTRACT

A bamboo venetian blind panel is made without restrictions of bamboo types. The manufacturing method of the blind panel includes the processes of splitting raw bamboos to bamboo blades, repeated splitting the bamboo plates to form fine bamboo blades, trimming, bleaching and drying the fine bamboo blades, arranging the fine bamboo blades in a juxtaposed manner, pressing the fine bamboo blades between a hot roller and a press roller with a hot adhesive vertically placed on a bottom surface of the fine bamboo blades to allow the fine bamboo blades forming a tentative bonding therebetween to form a board which includes a top plate and a bottom plate, bonding a fabric sheet to the bottom of the top plate, bonding and pressing the top plate and the bottom plate with the fabric sheet sandwiched therebetween to form a body with the fine bamboo blades on the top plate and the bottom plate laid in a staggered manner, polishing the body by sanding, cutting the polished body according to a desired length to form a blind panel, coating the blind panel with paints to maintain the blind panel at a selected thickness and make the blind panel waterproof and moistureproof, punching holes on two ends of the coated blind panel for threading ladder tapes, and assembling the punched blind panels to form a finished product.

1 Claim, 7 Drawing Sheets

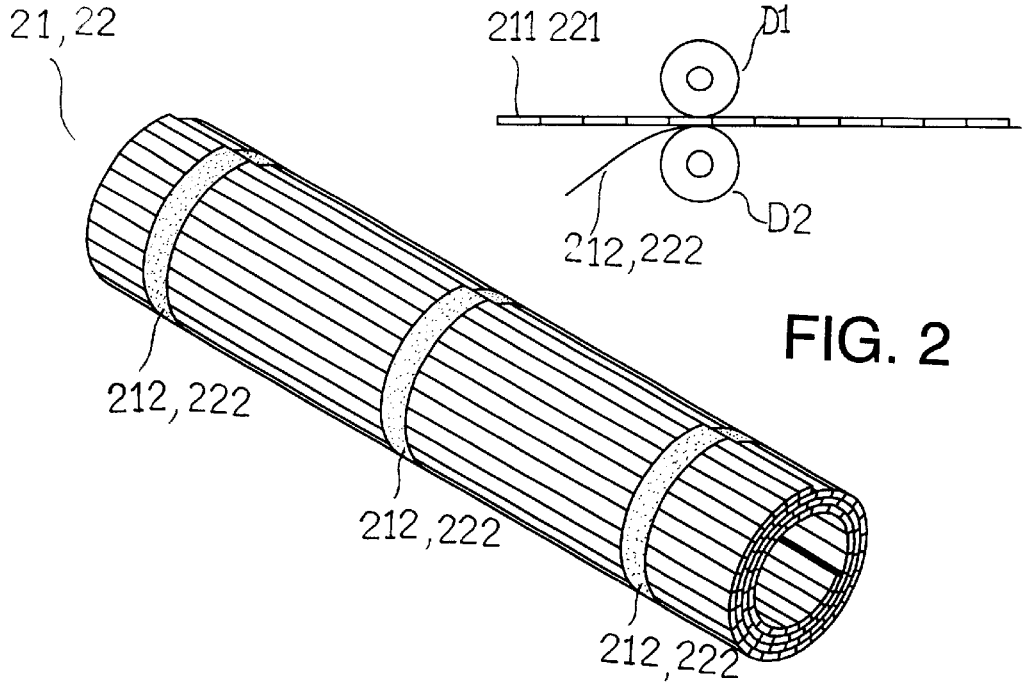
FIG. 2
FIG. 3
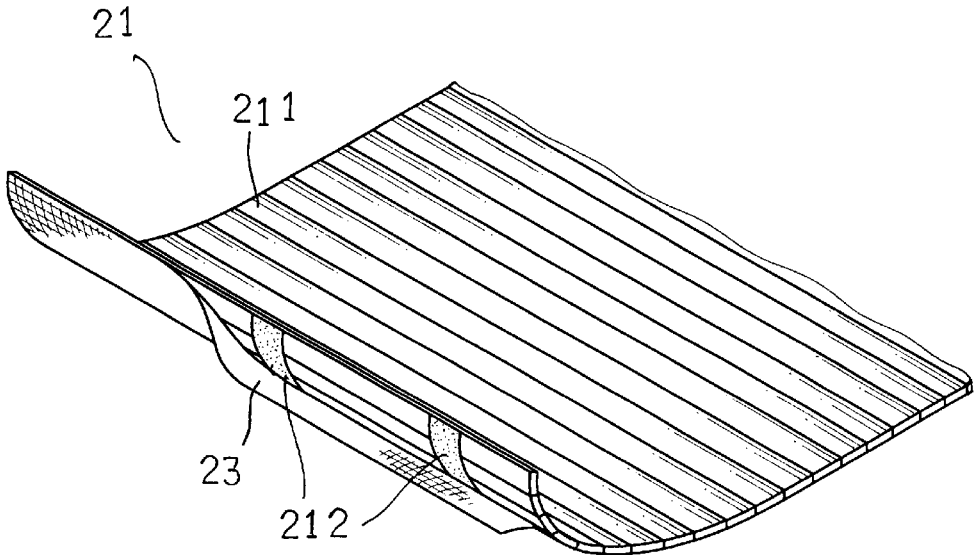
FIG. 4

BAMBOO VENETIAN BLIND PANELS AND METHOD FOR MANUFACTURING THE SAME

BACKGROUND OF THE INVENTION

1. Field of the Invention

The invention relates to bamboo venetian blind panels and method for manufacturing the same, and particularly bamboo venetian blind panels made from bamboos of subject to no restrictions of bamboo types.

2. Description of the Prior Art

Conventional Venetian blind panels generally are made of plastics, aluminum blades or the like. The materials being used do not conform to environmental protection requirements, and have become a burden to earth. How to reduce consumption of plastics, aluminum, or the like have become a great concern to mankind nowadays. Similarly, over consumption of woods tends to deplete an important natural resource and causes ecological unbalance. Hence many countries have strict regulations to prohibit or limit wood lumbering. As a result, procurement of woods has become increasingly difficult. As bamboos can be grown in large scales, to use bamboos as a substitute for plastic, aluminum and woods has become an attractive alternative. However bamboos usually have a lot of air apertures, abundant of fibers and strong toughness. They are more difficult to fabricate than woods. Moreover, bamboos generally do not have enough thickness. To make bamboo plates and blades of large sizes often has to resort to pressing processes. The fibrous and tough properties of bamboo tend to form bulged curves or uneven surfaces on the finished products. Hence they are generally being fabricated by braiding to produce goods such as mattresses, pillows, rolling curtains, etc. In the industry there are some producers trying to utilize bamboos as material for making blind panels. The bamboos being used generally are relatively large sizes (such as bamboos in the types of Nanchu and Machu) with diameters about 9" or more, and thickness of 10 mm). The raw bamboos have to go through a lot of processes, including removing internal and external knots, and bamboo skins, trimming and leveling both sides, splitting bamboos in blades, bleaching, drying, sanding single side, repeat splitting to form fine blades, painting and coating, hot pressing for forming, punching holes, assembling finished products. The processes set forth above have the following disadvantages:

1. It is difficult to find and select bamboo materials: As a single panel has certain width dimension limitations (usually between 28 mm–50 mm), only raw bamboos having diameters of 9" or more can be used. Moreover, only bamboos in the types of Nanchu and Machu can meet such requirements. Hence selection and procurement of bamboo have great limitations.
2. Forming blind panels is difficult: As blind panels have thickness in the range of 10 mm–20 mm, when fabricating and forming the panels from single pieces of raw bamboo material, bamboos are prone to fracture under hot pressing process because of bamboo fibers are general in parallel in longitudinal direction with the raw bamboos. As a result, defected products tend to increase.
3. The blind panels are easy to deform: Bamboo is a natural product. While fabrication processes such as coating may reduce moisture content of the bamboo materials, the bamboo materials still are prone to deform and twist because of their fibrous nature.

SUMMARY OF THE INVENTION

In view of aforesaid disadvantages, it is therefore a primary object of the invention to provide blind panels made by assembling bamboo blades, and a method for fabricating the blind panels that does not have restrictions on bamboo types, and also does not have restrictions on the thickness and length of raw bamboos. The method of the invention includes processes of splitting raw bamboos to bamboo blades, repeating splitting to form fine bamboo blades, trimming, bleaching and drying bamboo blades, then arranging the bamboo blades in a juxtaposed manner and bonding the bamboo blades with a hot adhesive to form a board with a tentative bonding. The board is used to form a top plate and a bottom plate. The bottom of the top plate is bonded to a fabric sheet. Then the top plate and bottom plate are bonded and compressed to form a body. Blades on the top plate and bottom plate are laid in a slightly staggered manner. The body then is polished by sanding process, then is cut to form blind panels of selected lengths. The cut panels are painted and coated, and punched to form holes to become finished products. The fabric sheet bonded between the top and bottom plates allows the two plates to form a secured and smug bonding with harnessing effect. The bamboo blades on the two plates are laid and bonded in a staggered manner to give the blind panel desired elasticity.

The foregoing, as well as additional objects, features and advantages of the invention will be more readily apparent from the following detailed description, which proceeds with reference to the accompanying drawings.

BRIEF DESCRIPTION OF THE DRAWINGS

FIG. 2 is a schematic side view of forming tentative bonding between bamboo blades according to the invention.

FIG. 3 is a schematic view of a board of the invention.

FIG. 4 is a schematic view for bonding a top plate to a fabric sheet.

DETAILED DESCRIPTION OF THE INVENTION

Figure 1:
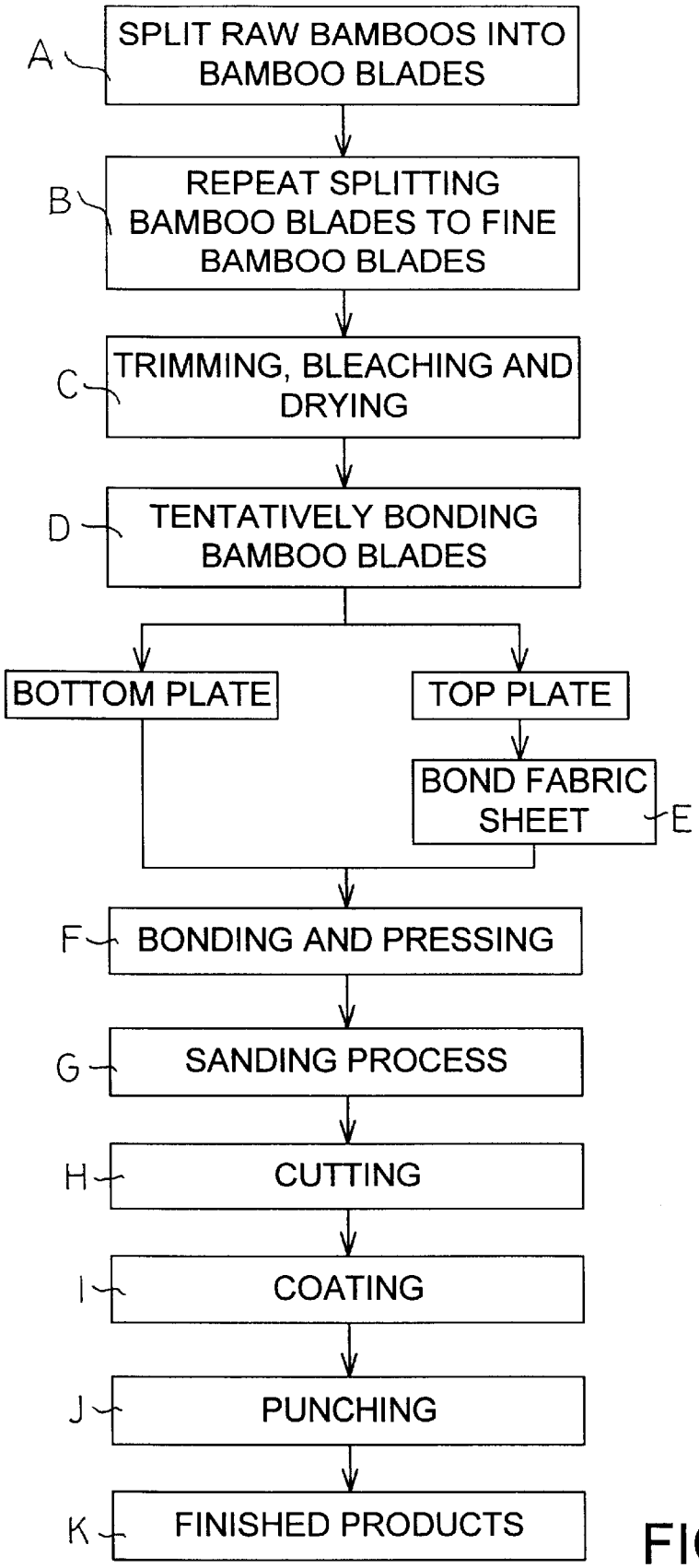
FIG. 1 is a fabrication process flow of the invention.

Referring to FIG. 1, the method of the invention includes the following steps:

A. splitting raw bamboos in blades: raw bamboos are split to form a plurality of small raw bamboo blades;

B. repeated splitting: repeat splitting operations to divide the small raw bamboo blades to form more fine bamboo blades, and remove internal and external bamboo knots, and bamboo skins from the fine bamboo blades to form bamboo blades with a thickness about 1 mm, and a width in the range of 5 mm and 10 mm;

C. trimming, bleaching, drying: the bamboo blades are trimmed to form smooth surfaces, and are bleached (processed with industrial hydrogen peroxide solution), then are dried at temperature between 50° C. and 60° C. to remove moisture in the bamboo blades.

D. Tentatively bonding the bamboo blades: the dehydrated bamboo blades 211 (221) are laid in a juxtaposed manner and are fed to a rolling bed formed between a hot roller D2 and a press roller D1, the bottom of the bamboo blades 211 (221) has a hot adhesive 212 (222) vertically placed thereon and are moved forwards together with the bamboo blades 211 (221) to allow the hot adhesive 212 (222) melted into the bottom of the bamboo blades 211 (221) after calendering by the hot roller D2, and the bamboo blades 211 (221) may be adhered to other bamboo blades 211 (221) to form a board with a tentative bonding (as shown in FIG. 2). Then the board is divided in a top plate 21 and a bottom plate 22 (as shown in FIG. 3).

Figure 5:
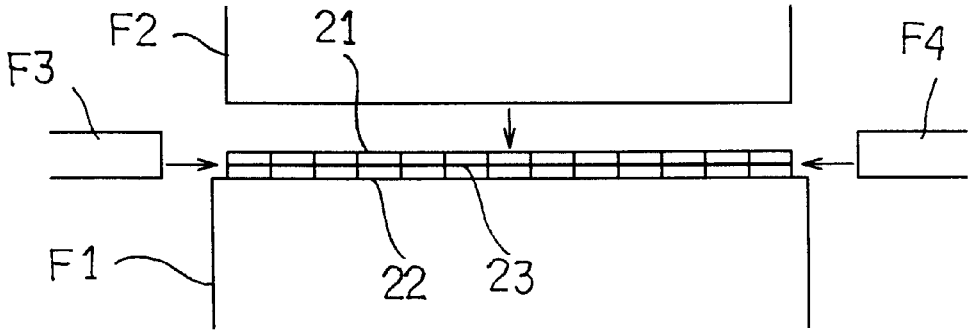
FIG. 5 is a schematic view for bonding and pressing a top plate to a bottom plate
Figure 6:
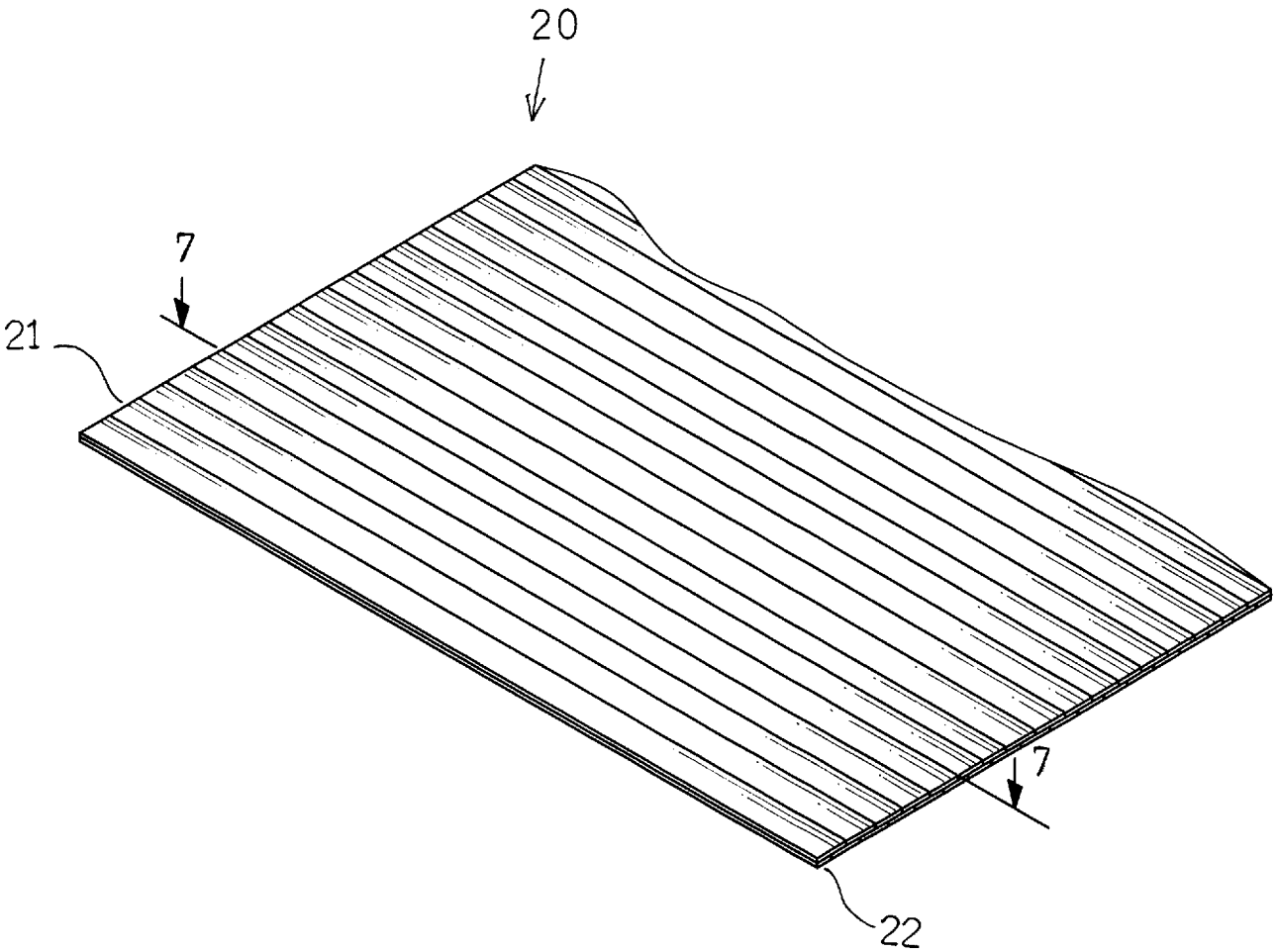
FIG. 6 is a schematic view of a body of the invention.
Figure 7:
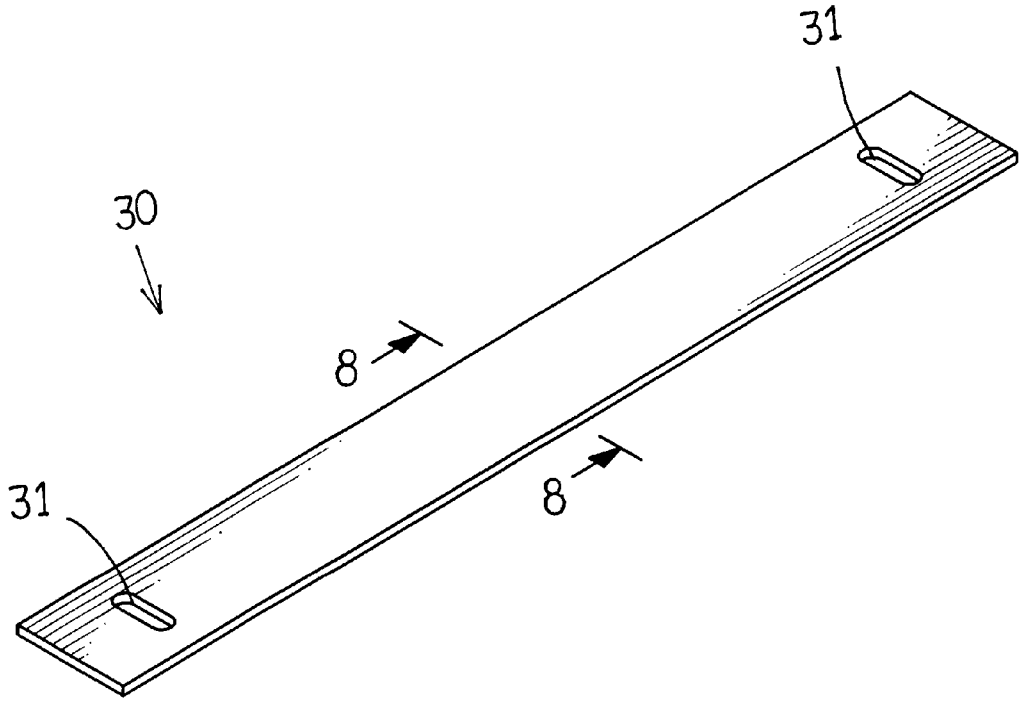
FIG. 7 is a cross section taken along line 7—7 in FIG. 6.
Figure 8:
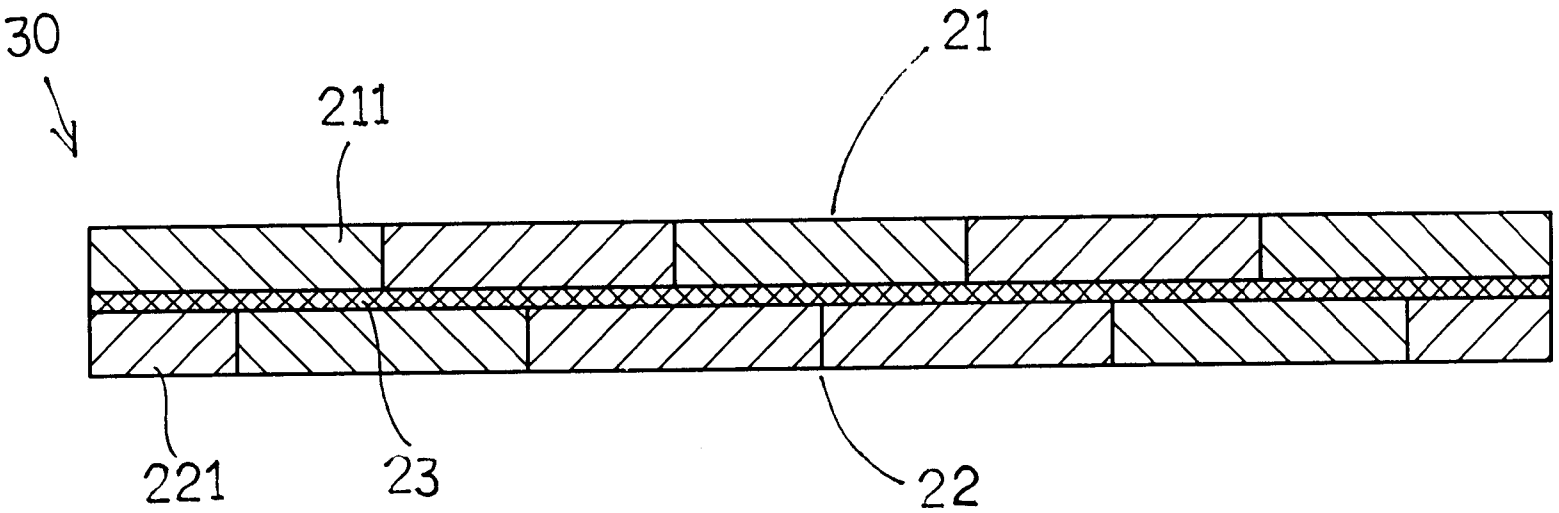
FIG. 8 is a cross section taken along line 8—8 in FIG. 7.

E. bonding fabric sheet: the bottom side of the top plate 21 is coated with adhesive to bond to a fabric sheet 23 (as shown in FIG. 4);

F. bonding and pressing: press the bottom plate 22 against the top plate 21 which attached to the fabric sheet 23 to proceed bonding and pressing processes to form a body 20 (as shown in FIG. 6, with the blades 211, 221 on the plates 21, 22 slightly staggered against one another). Aforesaid processes include coating the bottom surface of the bottom plate 22 with an adhesive to bond to the fabric sheet 23 on the top plates 21, then place the bonded bamboo plates on press molds F2, F3, F4 and press the bamboo plates with an oil hydraulic press F1 (as shown in FIG. 5);

G. sanding process: polish two sides of the body 20 by a sanding process to make the surfaces of the body 20 smooth;

H. cutting: cut the polished body 20 according to desired lengths and widths (as shown in FIG. 6) to become blind panels 30;

I. coating: coat the blind panels 30 with paints or lacquer to make the blind panels 30 waterproof and moisture-proof;

J. punching apertures: punch two ends of the coated blind panels 30 to form respectively a hole 31 on both ends (as shown in FIGS. 7 and 8) for threading a ladder tape;

K. completing finished products: assemble the punched blind panels 30 to form Venetian blinds.

Figure 9:
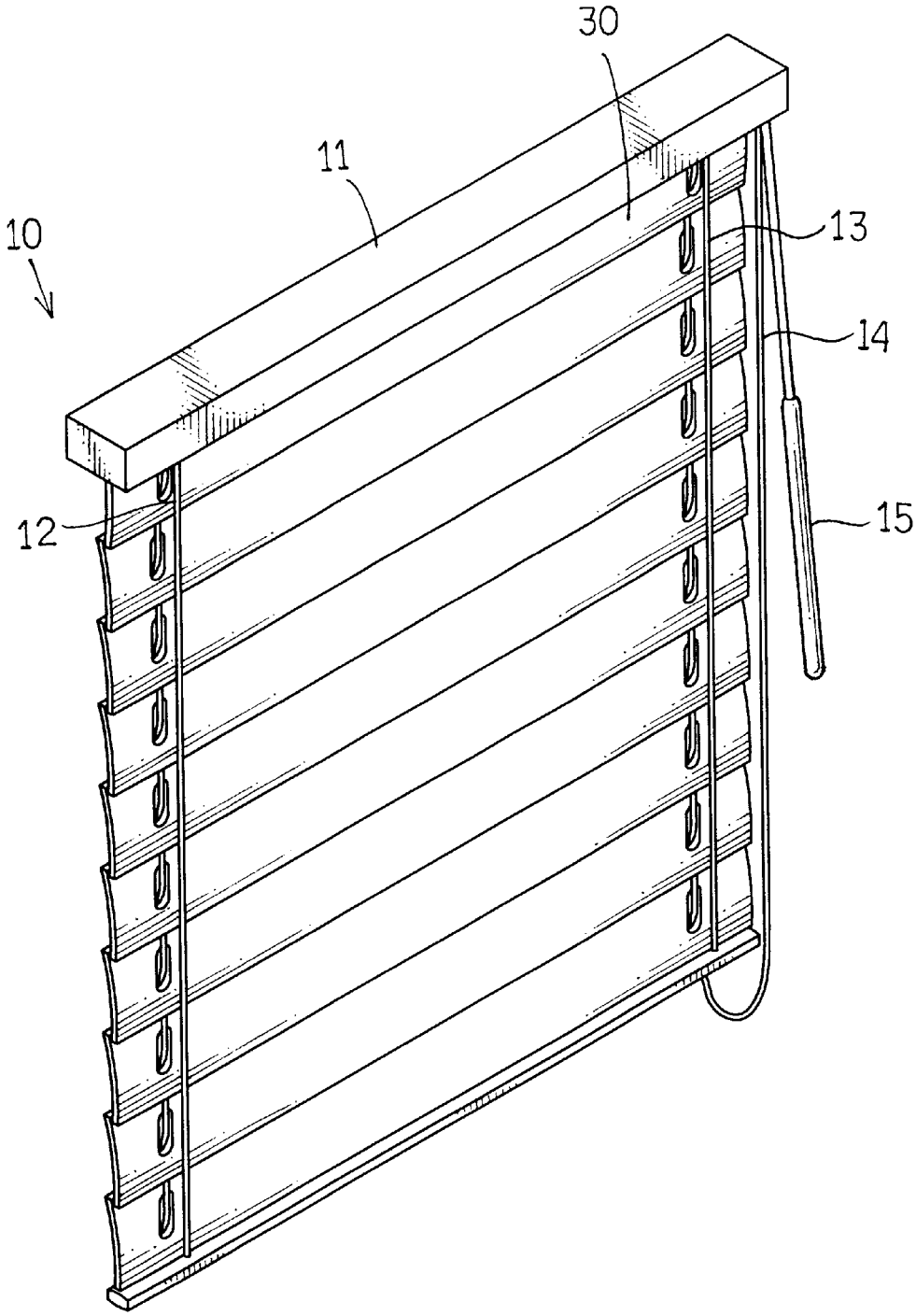
FIG. 9 is a schematic view of an embodiment of the invention.

Referring to FIG. 9 for making a Venetian blind 10 through utilizing the panels 30, an anchor bar 11 is provided on the top. The anchor bar 11 has two side walls which have respectively a control element (not shown in the drawing) pivotally mounted thereon. Each control element fastens to a ladder tap 12, 13 for holding a plurality of blind panels 30 thereon to form the Venetian blind 10. One of the control elements engages with a lift cord 14 for controlling lifting or lowering of the blind panels 30. Another control element may be engaged with a turning rod 15 for controlling turning angles of the blind panels 30.

In addition, the panel of the invention may be formed in an arched shape with two sides bending in a curve. This may be done after the punching hole process is completed. The panel may be transferred to a hot pressing process by placing the panel between an upper mold and a lower mold, and pressing the panel under heat to form the arched panel.

Comparing with panels made from conventional bamboo materials, the panel of the invention has the following advantages:

1. No restrictions on bamboo types: the invention is made from piecing and bonding a plurality of bamboo blades (each bamboo blade has a width between 5 mm and 10 mm, and a thickness about 1 mm), hence any types of bamboo materials may be used.
2. No restrictions on the thickness of bamboo materials: the blind panel 30 of the invention is formed by sandwiching a fabric sheet 23 between two plates 21, 22. Hence there is not thickness limitation on the raw bamboo materials. The panel may be made with better elasticity.
3. The panel may be cut to desired widths. The body of the invention may have a wide range of width and is more versatile. The panel may have more selections on length and width dimensions, thus the Venetian blinds may have a wide variety of dimensions and designs.
4. The panel 30 is formed by two plates 21, 22 sandwiching a fabric sheet 23 in the middle. The fabric sheet 23 provides secured bonding for the plates 21, 22, and can prevent the blades from incurring deformation or twist regardless the fibrous and tough properties of the bamboo, or under a damped condition. The bonding of the fabric sheet 23 also provides harness to the plates 21, 22 and may prevent the blind panel 30 from incurring deformation or uneven surface.
5. The bamboo blades 211, 221 on the two plates 21, 22 are laid in a staggered manner (as shown in FIG. 8), and the fabric sheet 23 is sandwiched between the plates 21, 22. After forming by hot pressing, a constraint effect will be created to prevent the plates from breaking.

By means of the construction and method of the invention set forth above, bamboo blind panels may be made without the restrictions of bamboo materials that happened to the conventional ones. The panels may be cut to a wide variety of lengths and widths to increase application versatility.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. A method for manufacturing bamboo Venetian blind panels, comprising steps of:

A. splitting raw bamboos to form a plurality of first small raw bamboo blades;

B. splitting each first small raw bamboo blade to form a plurality of second small bamboo blades, and removing internal and external bamboo knots and bamboo skins from the second small bamboo blades;

C. trimming, bleaching and drying the second small bamboo blades to form smooth surfaces thereon, and bleaching the second small bamboo blades with industrial hydrogen peroxide solution, then drying the bleached bamboo blades at a temperature between 50° C. and 60° C. to remove moisture in the bleached bamboo blades to form dehydrated bamboo blades;

D. bonding tentatively the dehydrated bamboo blades by arranging the dehydrated bamboo blades in a juxtaposed manner and pressing the dehydrated bamboo blades between a hot roller and a press roller with a hot adhesive vertically placed on a bottom surface of the bamboo blades to allow the hot adhesive melting into the bottom of the bamboo blades after calendering by the hot roller such that the dehydrated bamboo blades forming a tentative bonding between the dehydrated bamboo blades to form a board which includes a top plate and a bottom plate;

E. coating an adhesive on a bottom side of the top plate and bonding the bottom side to a fabric sheet;

F. bonding and pressing the bottom plate against the bottom side of the top plate to form a body, and placing the body on press molds for pressing by means of an oil hydraulic press;

G. polishing the body by a sanding process to form two smooth surfaces on the body;

H. cutting the polished body according to a desired length and a desired width to form a blind panel;

I. coating the blind panel with paints to make the blind panel waterproof and moistureproof;

J. punching two ends of the coated blind panel to form respectively a hole on each of the two ends for threading ladder tapes; and K. assembling the punched blind panel to form a Venetian blind.

* * * * *